US006073314A

United States Patent [19]

Barauke

[11] Patent Number: 6,073,314

[45] Date of Patent: Jun. 13, 2000

[54] DEVICE FOR CONDENSING A DRAFTED FIBER STRAND

[75] Inventor: Norbert Barauke, Donzdorf, Germany

[73] Assignee: Spindelfabrik Suessen, Schurr, Stahlecker & Grill GmbH, Suessen, Germany

[21] Appl. No.: 09/340,727

[22] Filed: Jun. 29, 1999

[30] Foreign Application Priority Data

Jul. 14, 1998 [DE] Germany ..... 198 31 508
Mar. 15, 1999 [DE] Germany ..... 199 11 333

[51] Int. Cl.[7] ..... D01H 5/86

[52] U.S. Cl. ..... 19/246; 19/150; 19/244; 19/288

[58] Field of Search ..... 19/150, 236, 237, 19/238, 239, 240, 241, 242, 243, 244, 245, 246, 247, 248, 249, 250, 252, 288, 263, 304, 305, 306, 307, 308

[56] References Cited

U.S. PATENT DOCUMENTS

| | | | |
|---|---|---|---|
| 2,659,936 | 11/1953 | Sandelin . | |
| 2,774,995 | 12/1956 | Sandelin . | |
| 3,090,081 | 5/1963 | Klein | 19/288 |
| 3,122,794 | 3/1964 | Klein | 19/288 |
| 4,485,528 | 12/1984 | Anahara et al. | 19/288 |
| 4,488,397 | 12/1984 | Venot . | |
| 4,953,349 | 9/1990 | Feher . | |
| 5,062,220 | 11/1991 | Keilhack | 34/155 |
| 5,600,872 | 2/1997 | Artzt et al. . | |

FOREIGN PATENT DOCUMENTS

| | | |
|---|---|---|
| 361 814 | 4/1981 | Austria . |
| 0085017 | 8/1983 | European Pat. Off. . |
| 0 635 590 | 1/1995 | European Pat. Off. . |
| 1.044.932 | 6/1953 | France . |
| 1.117.278 | 5/1956 | France . |
| 1.490.473 | 6/1967 | France . |
| 1.503.693 | 10/1967 | France . |
| 857 168 | 11/1952 | Germany . |
| 882 066 | 7/1953 | Germany . |
| 900 182 | 12/1953 | Germany . |
| 1 035 024 | 7/1958 | Germany . |
| 1 039 422 | 3/1959 | Germany . |
| 1 178 749 | 9/1964 | Germany . |
| 37 41 431 | 6/1989 | Germany . |
| 43 23 472 | 1/1995 | Germany . |
| 296 00 417 | 4/1996 | Germany . |
| 197 41 441 | 9/1997 | Germany . |
| 198 15 054 | 4/1998 | Germany . |
| 827787 | 6/1957 | United Kingdom . |
| WO 98/39505 | 9/1998 | WIPO . |

*Primary Examiner*—John J. Calvert
*Assistant Examiner*—Gary L. Welch
*Attorney, Agent, or Firm*—Evenson, McKeown, Edwards & Lenahan, P.L.L.C.

[57] ABSTRACT

A condensing zone is arranged downstream of the front roller pair of a drafting arrangement of a spinning machine, in which condensing zone a ready drafted fiber strand is condensed by means of rolling in the edge fibers before the yarn to be spun is imparted a twist. The condensing arrangement comprises a sliding surface having a suction slit extending essentially in a fiber strand transport direction, as well as a perforated transport belt which transports the fiber strand over the sliding surface and the suction slit. The sliding surface is the outer contour of a hollow profile, to which a suction device is connected. The transport belt consists of such a thin material that the fiber strand is disposed on the sliding surface and the suction slit at practically no distance thereto. The transport belt is preferably made from polyamide multifilament yarns.

33 Claims, 3 Drawing Sheets

DEVICE FOR CONDENSING A DRAFTED FIBER STRAND

BACKGROUND AND SUMMARY OF THE INVENTION

This application claims the priority of German applications 198 31 508.2 and 199 11 333.5 filed in Germany on Jul. 14, 1998, and Mar. 15, 1999, respectively, the disclosures of which are expressly incorporated by reference herein.

The present invention relates to an arrangement for condensing a drafted fiber strand in a condensing zone arranged downstream of a front roller pair of a drafting arrangement, which condensing zone comprises a sliding surface having a suction slit extending in essentially a fiber strand transport direction, and which condensing zone also comprises a perforated transport belt which transports the fiber strand over the sliding surface.

In the case of a device of this type (U.S. Pat. No. 5,600,872), the transport belt is made in the way of a drafting arrangement belt, but consists, however, of a material which has a greater elasticity. The greater elasticity can be achieved in that, for example, the transport belt used in the condensing zone has no fabric inserts. The transport belt comprises, centrical to the transport direction, perforations whose size is dependent upon the yarn number of said fiber strand and which determine the condensing of the drafted fiber strand. The perforations therefore determine the width to which the fiber strand is to be condensed.

The geometry of the known transport belt inevitably means that there is a certain distance between the fiber strand to be condensed and the suction slit. The perforations of the transport belt also cannot measure less than a certain minimum size, and there has to be a minimum distance between two perforations. Overall, the result is a not very homogeneous suction, which furthermore, in particular due to the inevitably occurring inleaked air, requires a relatively strong vacuum source.

It is an object of the present invention to ensure the best possible homogeneous suction in the condensing zone, without an all too high vacuum being necessary.

This object has been achieved in accordance with the present invention in that the transport belt is made of such a thin material that the fiber strand is disposed on the sliding surface and the suction slit at practically no distance thereto.

A very finely perforated woven, knitted or warp knit material can be used for the transport belt. Thin, perforated foils made of plastic or metal are also contemplated.

In contrast to the above described prior art, in the case of the present invention it is the suction slit located under the transport belt which determines the degree of condensing, rather than the size of the perforations. The perforations of the transport belt, which can be very fine and close meshed in a fabric, ensure a very even and thus homogeneous airflow. Because the transport belt, due to the thin material, is disposed on the sliding surface and the suction slit at practically no distance thereto, all the air which is sucked in becomes practically "effective air", which results in a particularly good degree of effectiveness in condensing. Practically no air is sucked in which is not used effectively during condensing.

A woven fabric comprising polyamide multifilament yarns having a diameter of less than 0.1 mm, for example 0.08 mm, has proven to be suitable for the purpose of the present invention. Despite this very fine fabric, it is stiff enough for an edge guide due to the synthetic multifilaments.

The inside diameter of the openings of the perforation should measure at the most one tenth of the width of the suction slit. It has been shown that the finer the perforation, the more even the suction is. In the case of a foil it is sufficient when the transport belt is perforated only in the area of the suction slit, whereby the perforation should, however, be somewhat wider than the suction slit. In the case of woven, knitted or warp knit materials, the perforation can also be essentially limited to the area of the suction slit, whereby here also the air permeable area should be wider than the suction slit. The covering of fabric openings located laterally adjacent to the suction slit could be effected by a chemical finish.

In the case of warp knit or knitted materials, the inner diameter is taken to be the mesh width, in the case of woven fabrics the distance between adjacent warp fibers and adjacent weft fibers. In order to increase the air permeability in the area of the suction slit in the case of a woven fabric, it can be provided that in this area the number of warp fibers are reduced.

Although, as mentioned above, the fine perforations are desirable for technical reasons, they can result in practice in blockaging and thus to a reduction in air permeability. It can, therefore, for purely practical reasons, be necessary to make the openings larger than is technically advantageous, for example larger than the width of the fibers of the fiber material to be processed, so that any possible remaining fibers, or the like, are sucked through the openings thus avoiding blockages.

In certain preferred embodiments of the present invention, the suction slit extends slightly diagonally to the transport direction, whereby its width lies in the order of magnitude of 1.5 mm. The suction slit is thus wider than the ready condensed fiber strand, yet somewhat narrower than the not yet condensed fiber strand. The suction slit is best disposed at an angle of between 18 and 20° diagonally to the transport direction, which gives rise to slight false twist in the fiber strand to be condensed. The fiber strand hereby follows the direction of the suction slit and is falsely twisted by the transport belt, whereby the edge fibers are rolled inwards. This results in the desired reduced hairiness and at the same time to a better material utilization and thus to an increased tear resistance.

In certain preferred embodiments of the present invention, the transport belt is driven by a nipping roller, which presses the transport belt onto the sliding surface, whereby the suction slit extends to the nipping roller. The latter is particularly important in order to prevent the condensed fiber strand becoming undone before the fiber strand reaches the nipping gap. From the nipping line onwards begins the effect of the spinning twist, in relation to which the nipping roller forms a twist stop.

The disposition of the transport belt is then particularly close when the sliding surface is curved. This prevents the transport belt from rising occasionally from the sliding surface.

The transport belt forms advantageously an endless woven loop, whereby any points of discontinuity of the transport belt in transport direction are avoided. Points of discontinuity can result later in the undesirable moire effect when the spun yarn is woven.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
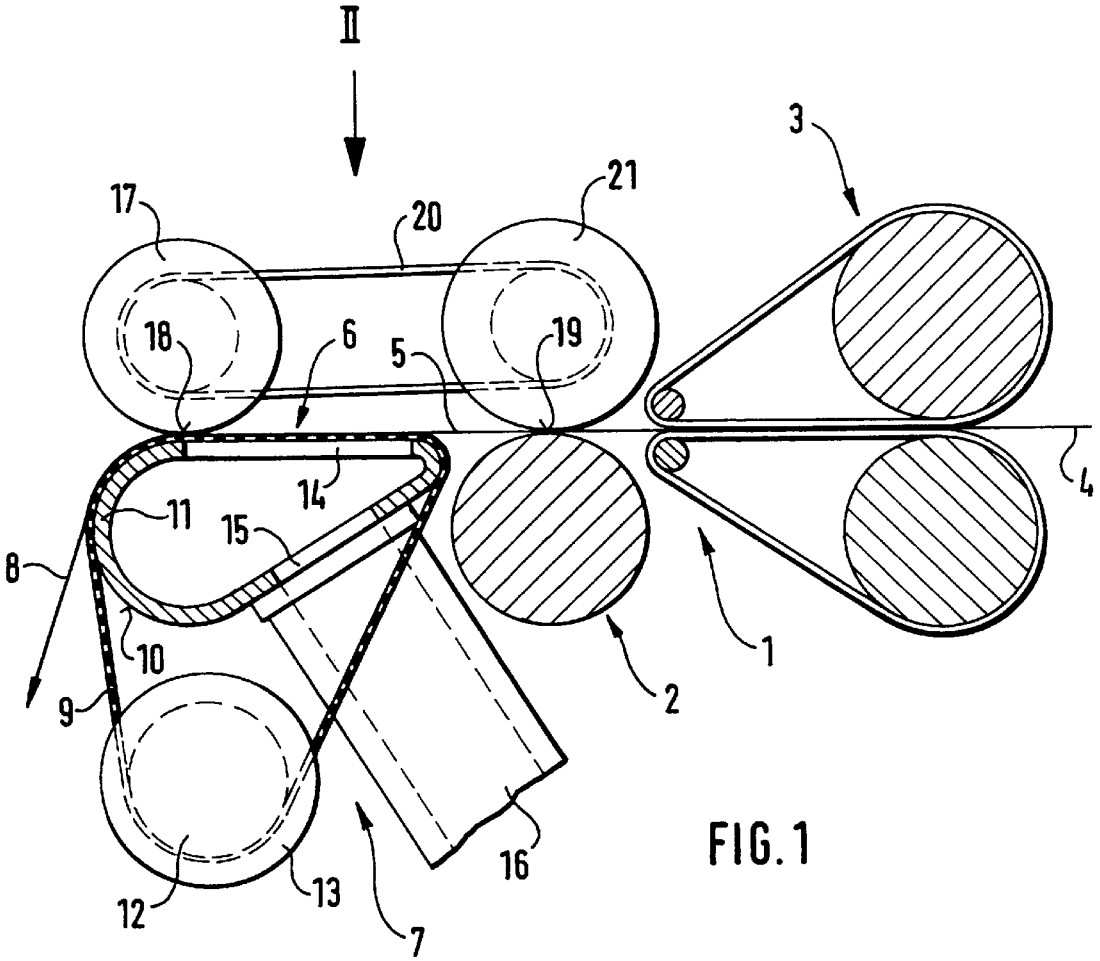
FIG. 1 is a part sectional side view of a device for condensing a drafted fiber strand, construed according to a preferred embodiment of the present invention.

Of the drafting arrangement 1 of a spinning machine, only the front roller pair 2 and the apron roller pair 3 arranged upstream thereto are shown in FIG. 1. The drafting arrangement 1 serves in a known way to draft a sliver or alternatively a roving 4. The sliver or roving 4 is ready drafted at the front roller pair 2, so that a drafted fiber strand 5 exists at that location, which fiber strand is condensed in a downstream condensing zone 6 adjoining the drafting arrangement 1. A device 7 condenses the drafted fiber strand 5 pneumatically in such a way that the edge fibers are rolled in, which leads to reduced hairiness and thus to an improved substance utilization of the yarn 8 to be spun. As shown in FIG. 1, the yarn 8 to be twisted downstream of the condensing zone 6 is fed to a ring spindle (not shown).

The device 7 comprises a perforated transport belt 9, which is formed for example as an endless woven fabric. The transport belt 9 runs over a stationary curved sliding surface 10, which is also designed as a suction device. The transport belt 9 serves to transport the fiber strand 5 to be condensed through the condensing zone 6. In the case of the sliding surface 10, the outer contour of a hollow profile 11 preferably extending over a plurality of spinning stations is provided. The tension of the transport belt 9 is produced by an additional tension roller 12, whose lateral edges 13 at the same time guide the transport belt 9 laterally. The sliding surface 10 comprises one suction slit 14 per spinning station, which suction slits 14 are directed from below against the perforated transport belt 9 in the condensing zone 6. On the side facing away from the sliding surface 10, the hollow profile 11 comprises a suction opening 15, which is connected to a vacuum source (not shown) by means of a connection 16. Air from outside can thus be suctioned through the fiber strand 5 to be condensed into the inside of the hollow profile 11 and later suctioned off by means of the connection 16.

A nipping roller 17 is provided downstream of the front roller pair 2 at a distance of somewhat more than the fiber staple length. This nipping roller 17 presses the transport belt 9 from above against the stationary hollow profile 11. This gives rise to a nipping line 18, which serves simultaneously as a twist stop for the twist applied to the yarn 8 by means of the ring spindle (not shown). The condensing zone 6 extends thus from the nipping line 19 of the front roller pair 2 to the nipping line 18 acting as a twist stop.

The nipping roller 17 is driven by means of a drive belt 20 by the front top roller 21 of the front roller pair 2. The speed ratio is so chosen that the nipping roller 17 runs essentially at the same circumferential speed as the front top roller 21, plus a small increase for the necessary tension draft of the fiber strand 5.

Figure 2:
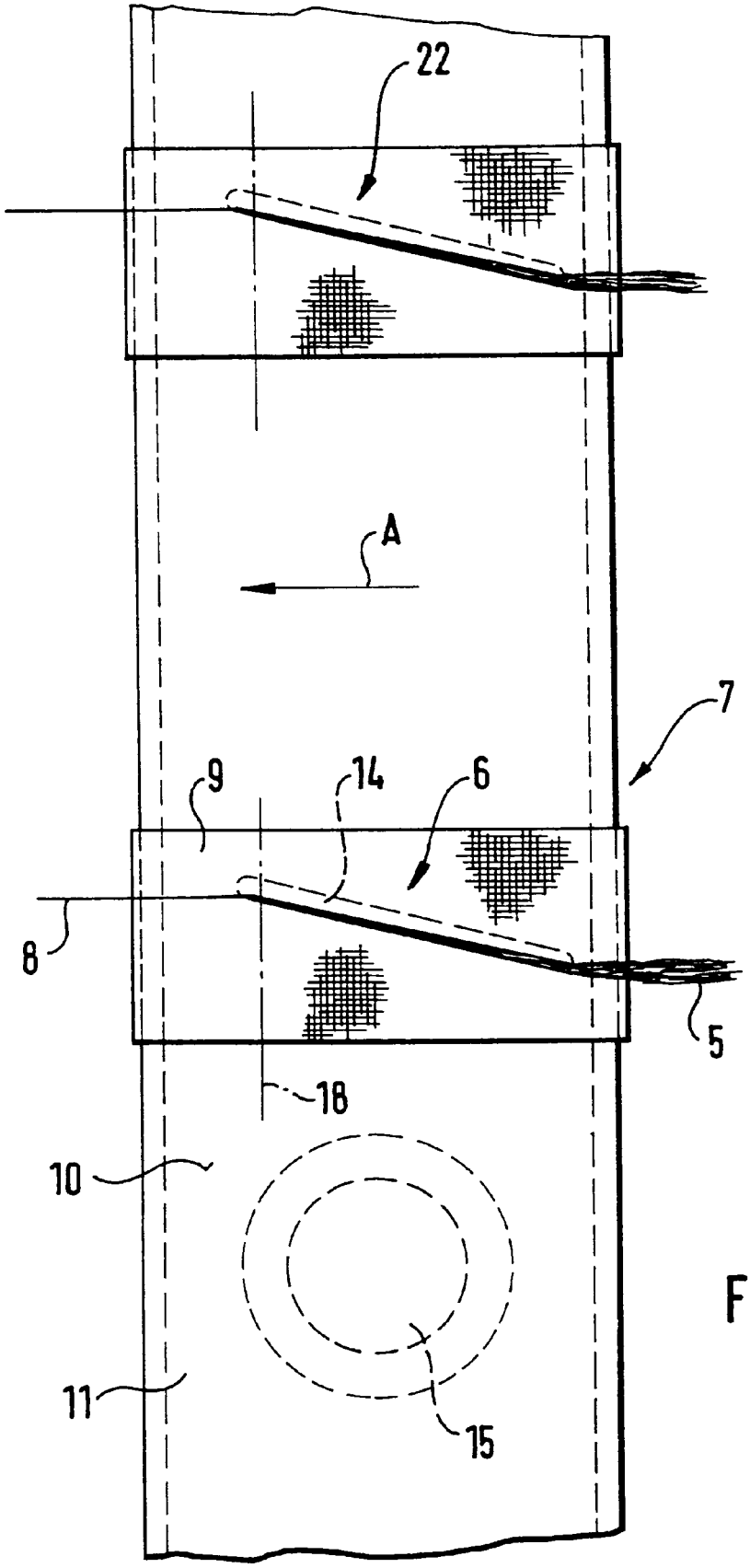
FIG. 2 is a schematic view in arrow direction II of FIG. 1 onto the sliding surface as well as onto two transport belts.

In FIG. 2 the hollow profile 11 of the device 7 as well as the sliding surface 10 for the transport belt 9 can be seen. The drafted fiber strand 5 to be condensed travels into the condensing zone 6 and is guided onwards as a condensed yarn 8 to be twisted. In addition to the condensing zone 6, an adjacent condensing zone 22 of an adjacent spinning station is also shown. The position of the suction slit 14 can be seen, slightly inclined in relation to the transport direction A, which suction slit 14 begins directly downstream of the nipping line 19 of the front roller pair 2 and extends to the nipping line 18 (shown only by a dot-dash line). The width of the suction slit 14 is somewhat narrower at the start than the fiber strand 5 to be condensed, but over most of its length it is significantly wider than the fiber strand 5. The suction slit 14 imparts in connection with the transport belt 9 a slight false twist to the fiber strand 5. The suction air required for this is removed by means of the suction opening 15 and the connection 16 to the vacuum source. Only one single suction opening 15 is provided for a plurality of spinning stations.

Figure 3:
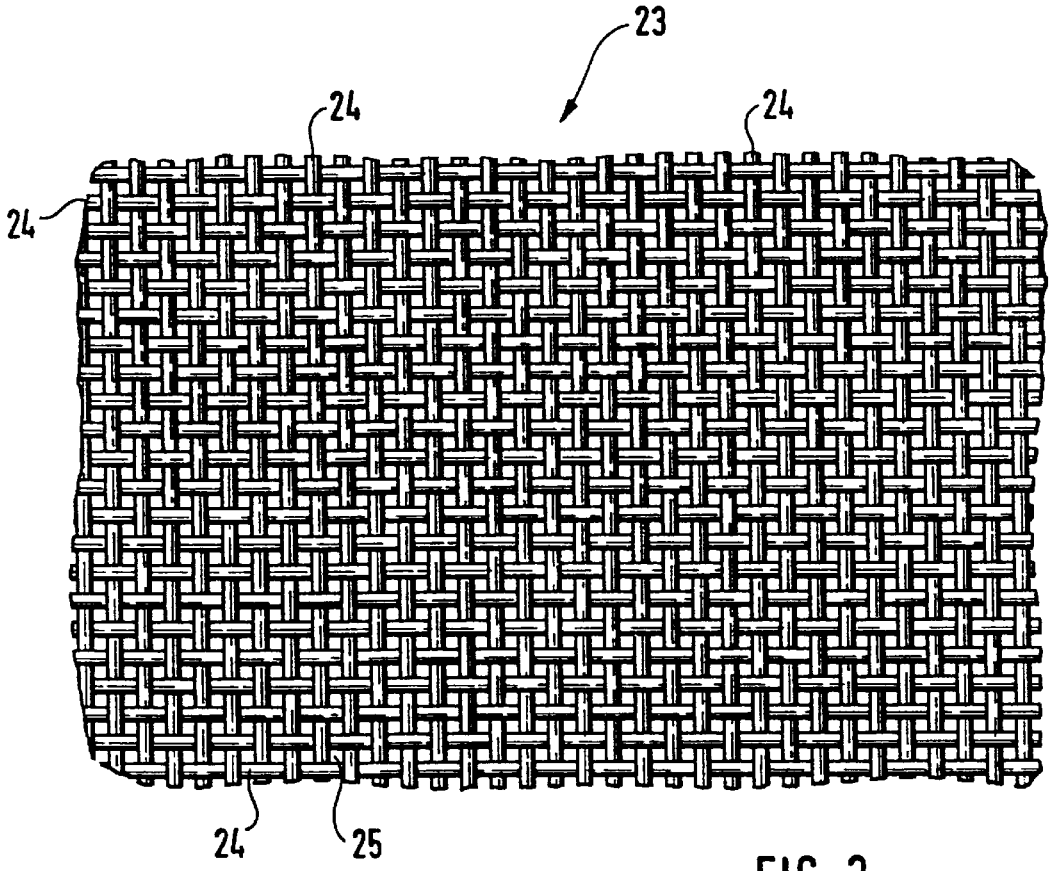
FIG. 3 is a view in greatly enlarged dimensions of a section of fabric of which the transport belt is made.

The greatly enlarged drawing in FIG. 3 shows a part of a woven fabric 23 of which the transport belt 9 forms preferably an endless loop. Polyamid multifilament yarns 24, whose diameter measures less than 0.1 mm, preferably even only 0.08 mm, have proven to be suitable. The longitudinal edges of the transport belt 9 are welded, which is possible due to the polyamide multifilament yarns 24.

The perforation of the fabric 23 is very close, the clearance of the openings 25 measuring less than 0.1 mm. This results in the air stream suctioned through the transport belt 9 being extremely homogeneous.

Due to the very fine perforation of the fabric 23, the transport belt 9 is so thin that the fiber strand 5 to be condensed is disposed on the sliding surface 10 and the suction slit 14 without any distance thereto. In preferred embodiments, the perforated transport belt measures no more than 0.5 mm. Thus there is practically no inleaked air, and all the air suctioned in can be considered as "effective air" for condensing. Therefore a relatively low vacuum is needed, and the degree of effectiveness is very high. The quality of the yarn 8 to be spun is above average due to the condensing zone 6 according to the present invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for condensing a drafted fiber strand in a condensing zone arranged downstream of a delivery roller pair of a drafting arrangement, which condensing zone comprises a sliding surface having a suction slit extending in essentially a fiber strand transport direction, and which condensing zone also comprises a perforated transport belt which transports the fiber strand over the sliding surface, wherein said transport belt includes a perforation pattern with plural perforations across the suction slit in a direction transverse to a travel direction of a fiber strand over the sliding surface and suction slit, and wherein the transport belt consists of such a thin material that the fiber strand is disposed on the sliding surface at a minimal distance from the suction slit.

2. An arrangement according to claim 1, wherein the material of the transport belt is a fabric which consists of polyamide multifilament yarns having a diameter of less than 0.1 mm.

3. An arrangement according to claim 2, wherein the perforation pattern of the transport belt includes openings, the clearance of which openings measures at most a tenth of the width of the suction slit.

4. An arrangement according to claim 2, wherein the suction slit extends slightly inclined in relation to the transport direction, and wherein the width of the suction slit is approximately 1.5 mm.

5. An arrangement according to claim 2, wherein the transport belt is driven by a nipping roller, which nipping roller presses the transport belt to the sliding surface, and wherein the suction slit extends to the nipping roller.

6. An arrangement according to claim 2, wherein the transport belt forms an endless woven loop.

7. An arrangement according to claim 2, wherein the maximum thickness of the transport belt material measures no more than 0.5 mm.

8. An arrangement according to claim 1, wherein the perforation pattern of the transport belt includes openings, the clearance of which openings measures at most a tenth of the width of the suction slit.

9. An arrangement according to claim 8, wherein the suction slit extends slightly inclined in relation to the transport direction, and wherein the width of the suction slit is approximately 1.5 mm.

10. An arrangement according to claim 8, wherein the transport belt is driven by a nipping roller, which nipping roller presses the transport belt to the sliding surface, and wherein the suction slit extends to the nipping roller.

11. An arrangement according to claim 8, wherein the transport belt forms an endless woven loop.

12. An arrangement according to claim 8, wherein the maximum thickness of the transport belt material measures no more than 0.5 mm.

13. An arrangement according to claim 1, wherein the suction slit extends slightly inclined in relation to the transport direction, and wherein the width of the suction slit is approximately 1.5 mm.

14. An arrangement according to claim 13, wherein the transport belt is driven by a nipping roller, which nipping roller presses the transport belt to the sliding surface, and wherein the suction slit extends to the nipping roller.

15. An arrangement according to claim 13, wherein the transport belt forms an endless woven loop.

16. An arrangement according to claim 13, wherein the maximum thickness of the transport belt material measures no more than 0.5 mm.

17. An arrangement according to claim 1, wherein the transport belt is driven by a nipping roller, which nipping roller presses the transport belt to the sliding surface, and wherein the suction slit extends to the nipping roller.

18. An arrangement according to claim 17, wherein the sliding surface is curved.

19. An arrangement according to claim 17, wherein the transport belt forms an endless woven loop.

20. An arrangement according to claim 17, wherein the maximum thickness of the transport belt material measures no more than 0.5 mm.

21. An arrangement according to claim 1, wherein the sliding surface is curved.

22. An arrangement according to claim 21, wherein the maximum thickness of the transport belt material measures no more than 0.5 mm.

23. An arrangement according to claim 1, wherein the transport belt forms an endless woven loop.

24. An arrangement according to claim 23, wherein the maximum thickness of the transport belt material measures no more than 0.5 mm.

25. An arrangement according to claim 1, wherein the maximum thickness of the transport belt material measures no more than 0.5 mm.

26. A fiber strand condensing assembly comprising:

a hollow member having a suction slit extending along a hollow member sliding surface section, and a perforated transport belt disposed to move directly on the sliding surface section while carrying a fiber strand, wherein the transport belt has a thickness of no more than 0.5 mm.

27. An assembly according to claim 26, wherein the transport belt is made of a fabric consisting of yarns having a diameter of less than 0.1 mm.

28. An assembly according to claim 27, wherein the suction slit is inclined by an angle of less than 25° with respect to the fiber strand transport direction over the sliding surface section.

29. An assembly according to claim 28, wherein the angle is between 18° and 20°.

30. A fiber strand transport belt for transporting a fiber strand over a suction slit of a hollow member while condensing the fiber strand, wherein the transport belt is perforated to permit flow of the suction air therethrough and has a thickness of no more than 0.5 mm, and wherein the transport belt has a perforated pattern with plural openings disposed laterally adjacent to one another, said perforated pattern, extending in use over the entire width of the suction slit transverse to a travel direction of the transport belt such that the plural laterally adjacent opening face the suction slit at all times.

31. A fiber strand transport belt according to claim 30, wherein the transport belt is made of a fabric consisting of yarns having a diameter of less than 0.1 mm.

32. A fiber strand transport belt according to claim 30, wherein the material of the transport belt is a fabric which consists of polyamide multifilament yarns having a diameter of less than 0.1 mm.

33. A fiber strand transport belt according to claim 30, wherein said fabric is woven, and wherein openings in the transport belt are at most a tenth of the width of the suction slit.

* * * * *